US010958013B1

(12) United States Patent
Peng et al.

(10) Patent No.: US 10,958,013 B1
(45) Date of Patent: Mar. 23, 2021

(54) WATERPROOF CONNECTOR

(71) Applicant: F TIME TECHNOLOGY INDUSTRIAL CO., LTD., New Taipei (TW)

(72) Inventors: Chang-Lin Peng, New Taipei (TW); Mei-Hsiang Yang, New Taipei (TW)

(73) Assignee: F TIME TECHNOLOGY INDUSTRIAL CO., LTD., New Taipei (TW)

( * ) Notice: Subject to any disclaimer, the term of this patent is extended or adjusted under 35 U.S.C. 154(b) by 0 days.

(21) Appl. No.: 16/748,289

(22) Filed: Jan. 21, 2020

(51) Int. Cl.
*H01R 13/52* (2006.01)
*H01R 24/28* (2011.01)

(52) U.S. Cl.
CPC ..... *H01R 13/5221* (2013.01); *H01R 24/28* (2013.01)

(58) Field of Classification Search
CPC .. G02B 6/3816; H04N 7/104; H01R 13/5221; H01R 24/28
See application file for complete search history.

(56) References Cited

U.S. PATENT DOCUMENTS 5,645,438 A * 7/1997 Cairns ..... G02B 6/3816 439/139
10,209,460 B2 * 2/2019 Tucker ..... H01R 13/04
10,608,372 B2 * 3/2020 Brierley ..... H01R 43/26

* cited by examiner

*Primary Examiner* — Vanessa Girardi
(74) *Attorney, Agent, or Firm* — Guice Patents PLLC

(57) ABSTRACT

A connector mainly includes a main base body, one end of which has a guide sleeve, the other end of the main base body has a butting holes, and the guide sleeve is connected with a connecting module. The connecting module further includes a connecting base which includes a connecting element. The connecting module further includes a butting seat correspondingly engages the guide sleeve, and a conductive module is housed inside the main base body. The conductive module further includes a central pin, and the central pin is provided with a second waterproof gasket. The second waterproof gasket for the central pin extending therethrough and abuts against a side of a convex seat. The central pin extends through a sleeve which is correspondingly connected with a conductive base, and the central pin is sleeved in the sleeve and the conductive base. Finally, the conductive module is further correspondingly sleeved with a fixing seat and a protective sleeve in sequence. A waterproof layer protrudes outward on the outer peripheral surface.

10 Claims, 10 Drawing Sheets

WATERPROOF CONNECTOR

BACKGROUND OF THE INVENTION

Field of the Invention

The invention relates to a connector, and more particularly to connector having waterproof function and providing stable signal transmission.

Description of the Related Art

Due to the rapid progress of wireless communication technology, the mobile devices, such as mobile phones, will install a connector thereon, so that after the signal line is inserted into the connector, the mobile device is disconnected with its own antenna receiving device and connected to an external antenna equipment. The connectors currently used, in addition to providing stable signal transmission, need to be able to adapt to different external environments and some sudden conditions, especially the influence of liquid or gas. The waterproof has become a very important issue in the connector technical field.

In the past, the earliest known technology used silicon rubber for the connection of the connector to protect the conductive circuit inside, but because the silicone coating will produce gaps, the waterproof effect is not as expected. Therefore, the subsequent known technology adapted waterproof gaskets for waterproofing, and the above-mentioned imperfections in silicone coating are improved by providing waterproof gaskets at each connection position of the connector.

However, the conventional technology uses a waterproof gasket as a waterproof means, which directly uses the connection means at each connection position, and directly clamps the waterproof gasket between the components so that the waterproof gasket is fixed at each connection position. In addition to the fact that the waterproof gasket is not easy to assemble or the fixed position is offset, the method directly affects the waterproof effect, and the assembly of the waterproof gasket is likely to affect the joint condition of the connector and the conductive efficiency of the connector.

BRIEF SUMMARY OF THE INVENTION

An object of the invention is to provide a connector with chamfers cooperating with waterproof gasket to improve the waterproof effect thereof.

Another object of the invention is to provide a connector, in which an insulation structure is added to a central pin, thereby improving the stability of signal transmission during the disconnection.

To achieve the objects of the invention, the invention provides a connector includes a main base body, a connecting module and a conductive module. One end of the main base body is provided with a guide sleeve, the outer peripheral surface of the guide sleeve has a through hole, the through hole is communicated with the main base body, and the other end of the main base body has a butting hole; a connecting module connected to the guide sleeve of the main base body. The connecting module further includes: a connecting base being a hollow base body, wherein one end of the connecting base is connected to a circular ring plate; a connecting element housed in the connecting base, two ends of the connecting element are in a concave shape, and a convex ring is provided on the outer peripheral surface of the connecting element; a first elastic element sleeved on the outer peripheral surface of the guiding element, wherein one end of the first elastic element props against the convex ring, and is accommodated in the connecting base along with one end of the connecting element; a butting seat accommodating the other end of the first elastic element and correspondingly connecting the guide sleeve, so that the guide module is fixed on the main base body, and a butting sleeve extends outwardly from the butting seat; and a first guide element corresponds to the through hole of the main base body, the first guide element has a receiving seat having a size corresponding to a size of the through hole, a guiding rod is provided in the receiving seat, and the guiding rod is movable in the receiving seat and extends into the main seat body. The conductive module is housed in the main base and includes: a central pin, a convex seat is provided on the outer peripheral surface of the central pin, and one end of the central pin has a conductive tip; a second elastic element sleeved on a pin body of the central pin with one end thereof propping on the convex seat; a second waterproof gasket sleeved on the central pin and abutting against the other side of the convex seat; a sleeve housing the center pin and having a first chamfer and a second chamfer on an outer peripheral surface thereof, and the sleeve simultaneously accommodates the conductive tip and the second elastic element; a conductive base is correspondingly connected to the sleeve, the central pin is sleeved in the sleeve and the conductive base, the other end of the central pin is located in the conductive base, and the conductive tip is exposed outside the sleeve; a fixing seat accommodated in the main seat body, wherein a through slot is provided at the axial position of the fixed seat, the through slot is configured to receive the sleeve, the conductive tip of the center pin is exposed from the fixing seat, a waterproof layer is projected outwardly on the outer peripheral surface of the fixing seat, and the waterproof layer is closely fitted to the inner peripheral surface of the main base body; and an protective sleeve sleeving the conductive tip for insulation.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
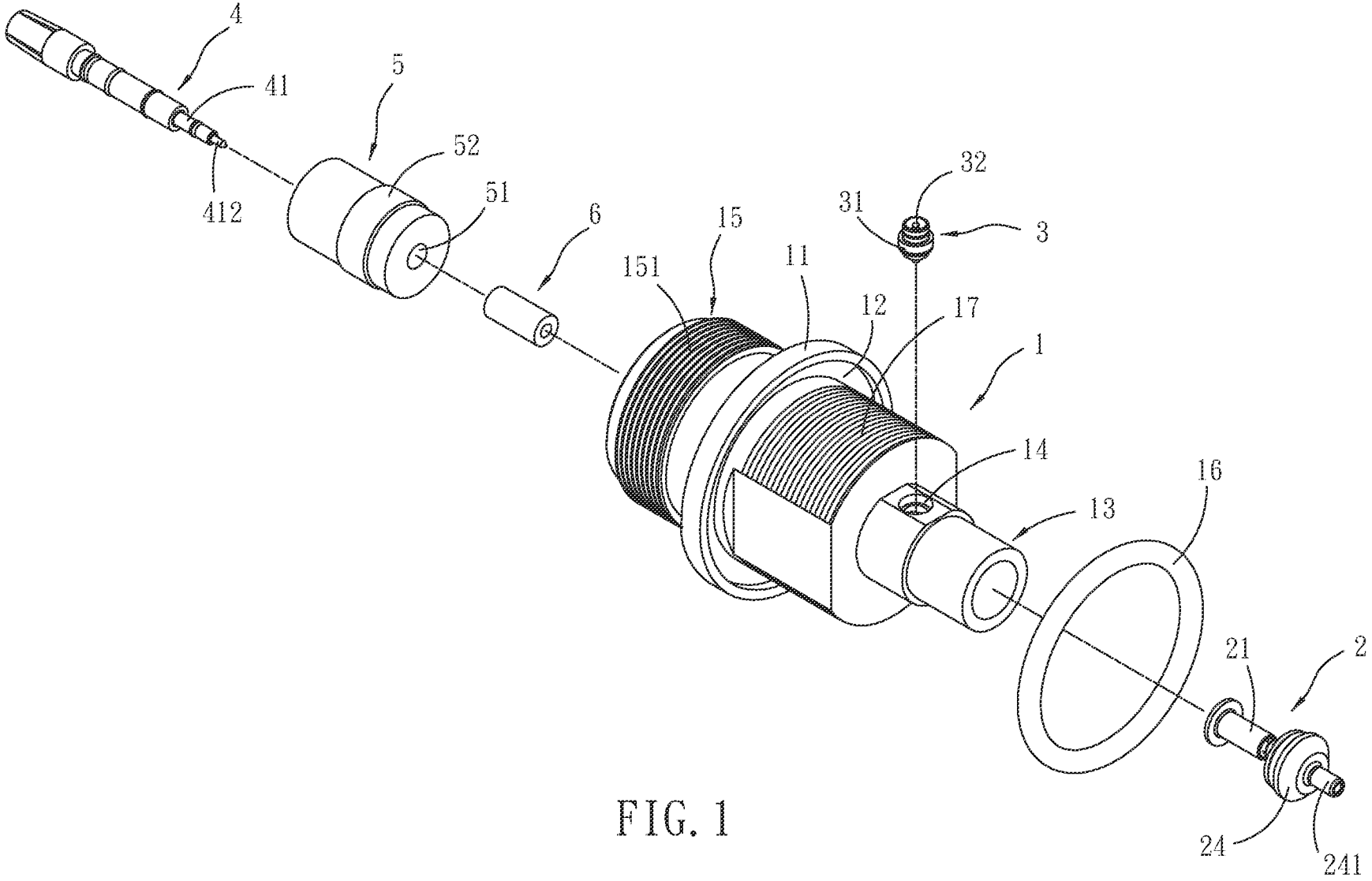
FIG. 1 is a perspective exploded view of a first embodiment of a connector of the invention.

Please referring to FIG. 1, which is an exploded view of a three-dimensional structure of the invention. As shown in FIG. 1, the connector of the invention includes a main base body 1 which is a hollow cylinder body. The outer peripheral surface of the main base body 1 is provided with an annular flange 11. The annular flange 11 is recessed inward to form a groove 12. One end of the main base body 1 is provided with a guide sleeve 13 which is cylindrical, and the outer surface of the guide sleeve 13 has a through hole. The through hole 14 is in communication with the main base body 1, and the other end of the main base body 1 has a butting hole 15. A diameter of the butting hole 15 is larger than a diameter of the guide sleeve 13. A threaded surface 151 can be provided on the outer peripheral surface of the butting hole 15 as a means to connect to an external connector 100. In addition, a first waterproof gasket 16 is accommodated at a position corresponding to the groove 12 to increase the waterproof effect of the main base body 1. The body base body 1 can be provided with screw teeth 17 on the outer peripheral surface between the groove 12 and the through hole 14.

Figure 2:
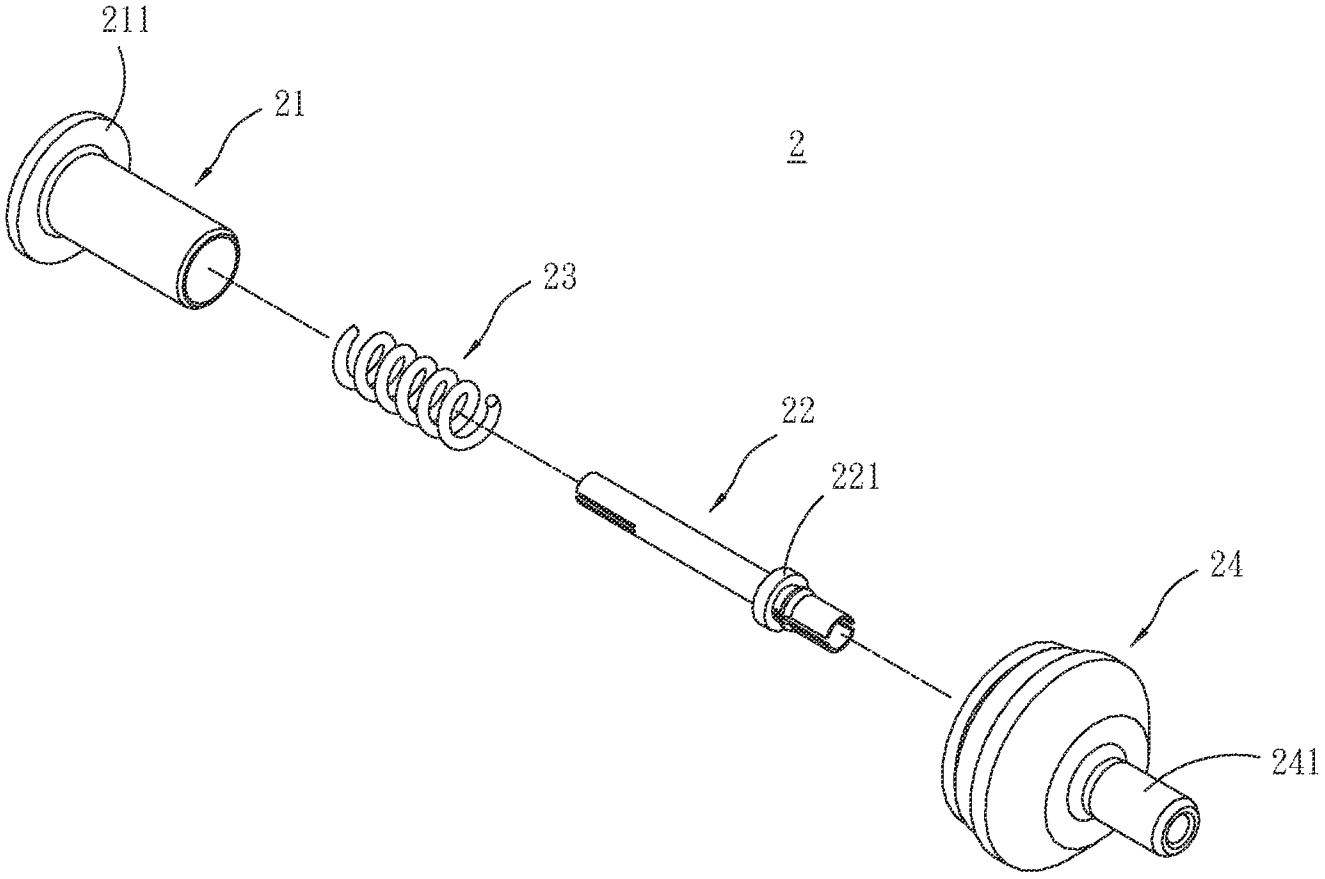
FIG. 2 is a partially exploded view of the first embodiment of a connector of the invention.

Referring to FIG. 1 again, the guide sleeve 13 of the main base body 1 is connected to a connecting module 2. According to the exploded view of the partial three-dimensional structure with reference to FIG. 2, the connecting module 2 further includes a connecting base 21, the connecting base 21 is a hollow base body, and has a T-shaped appearance. One end of the connecting base 21 is connected to an annular plate 211. A connecting element 22 is housed in the lead base 21. The connecting element 22 has a rod shape, and two ends of the connecting element 22 are in a concave shape. A convex ring 221 is provided on the outer peripheral surface of the connecting element 22, and a first elastic element 23 is sleeved on the outer peripheral surface of the guide element 22. The first elastic element 23 is a spring in this embodiment. One end of the first elastic element 23 props against the convex ring 221 and is accommodated in the connection base 21 with one end of the connecting element 22. The connection module 2 further includes a butting seat 24. The butting seat 24 is configured to accommodate the other end of the first elastic element 23. The butting seat 24 is circular and configured to correspondingly engage a hole of the guide sleeve 13, so that the connecting module 2 is fixed on the main seat body 1, and a butting sleeve 241 extends outwards from the butting seat 24.

Figure 3:
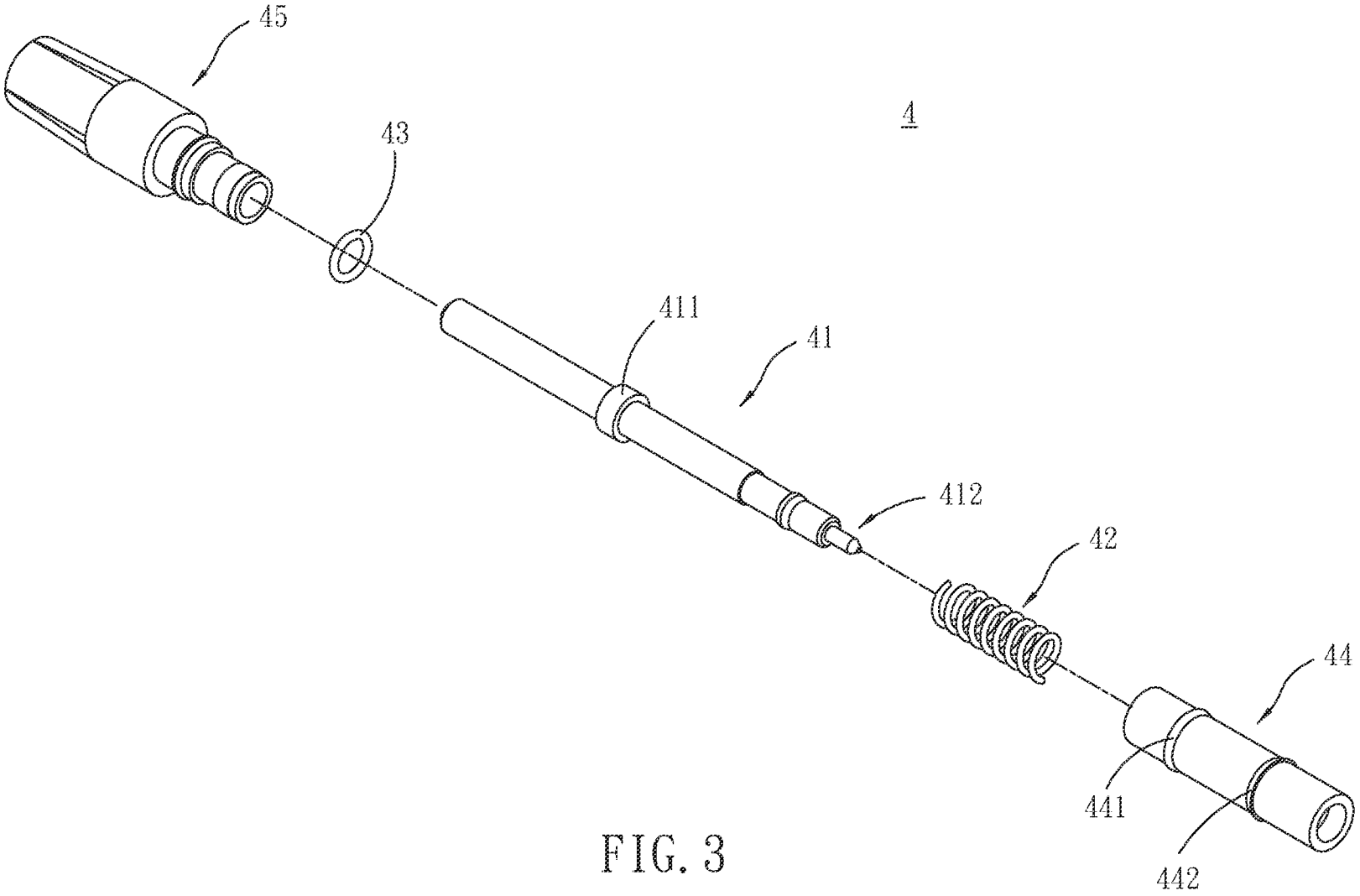
FIG. 3 is a partially exploded view of the first embodiment of a connector of the invention.

Referring to the FIG. 1 again, the through hole 14 of the main base body 1 is correspondingly for a first guide element 3 extending therethrough. The first guide element 3 has a receiving seat 31 corresponding to the size of the through hole 14. A guiding rod 32 is provided in the receiving seat 31, and the guiding rod 32 is fixed in the receiving seat 31 and extends into the main base body 1. A conductive module 4 is provided in the main base body 1. Referring to FIG. 3, the conductive module 4 further includes a central pin 41. A convex seat 411 is disposed on an outer peripheral surface of the central pin 41. A second elastic element 42 is sleeved on the pin body of the central pin 41. In this example, the second elastic element 42 is a spring. One end of the second elastic element 42 props against the convex seat 411. One end of the central pin 41 has a conductive tip 412. The pin body of the central pin 41 is provided with a second waterproof gasket 43. The second waterproof gasket 43 is inserted through the central pin 41 and abuts against the other side of the convex seat 411. The central pin 41 is inserted through a sleeve 44 having a first chamfer 441 and a second chamfer 442 on the outer peripheral surface of the sleeve 44. The first chamfer 441 and the second chamfer 442 are arranged in opposite directions. The sleeve 44 also accommodates the conductive tip 412 and the second elastic element 42, and the sleeve 44 is correspondingly connected to a conductive base 45, so that the central pin 41 is disposed in the sleeve 44 and the conductive base 45, while the other end of the central pin 41 is located in the conductive base 45, and the conductive tip 412 is exposed outside the sleeve 44.

Figure 4:
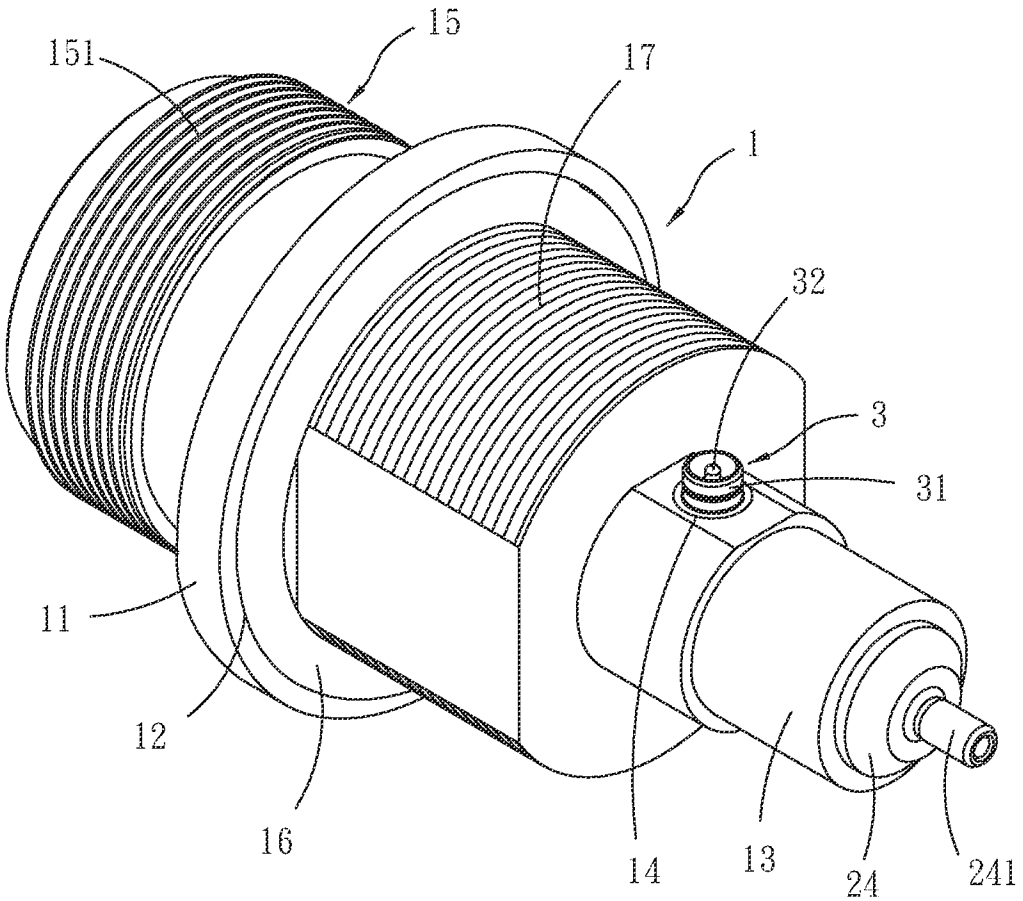
FIG. 4 is a perspective assembled view of a connector of the invention.

Referring to FIG. 1, the conductive module 4 is further correspondingly sleeved with a fixing seat 5 and a protective sleeve protective sleeve 6 in sequence, wherein the fixing seat 5 is a circular hollow cylinder, and the fixing seat 5 is housed in the main seat body 1, the relative position of the conductive module 4 in the main base body 1 is fixed, and a through slot 51 is provided at the axial center position of the fixing seat 5, and the through slot 51 is used to accommodate the sleeve 44, and the conductive tip 412 of the central pin 41 is exposed from the fixing seat 5. A waterproof layer 52 protrudes outward on the outer peripheral surface of the fixing seat 5. The waterproof layer 52 is closely fitted to the inner peripheral surface of the main base body 1. The protective sleeve 6 is sleeved on the conductive tip 412 for insulation and to increase the stability of the circuit (signal). In this embodiment, the protective sleeve 6 is made of insulating material; its three-dimensional assembled view is shown in FIG. 4.

Figure 5:
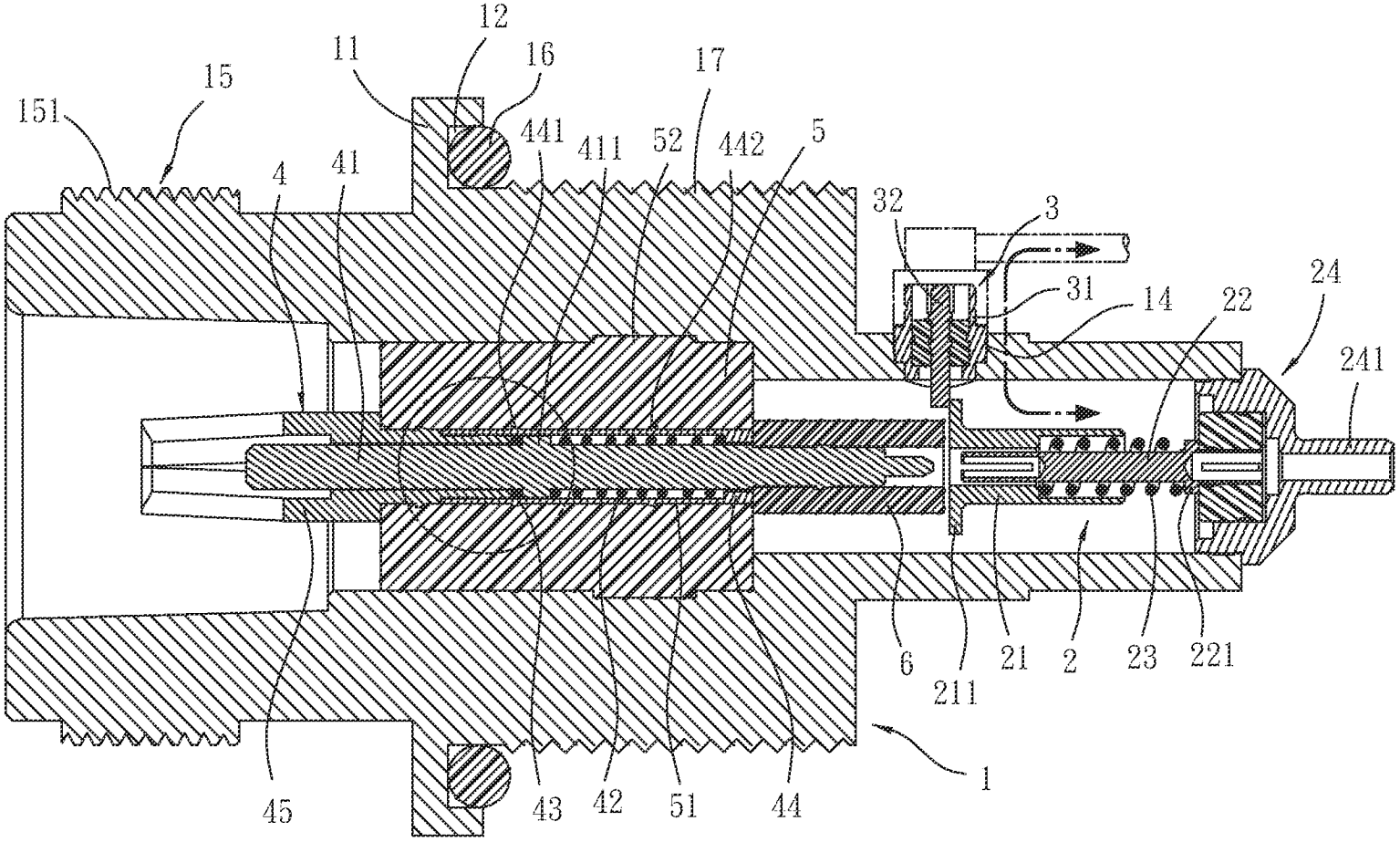
FIG. 5 is a cross sectional view of a connector of the invention when the connector is operated.
Figure 6:
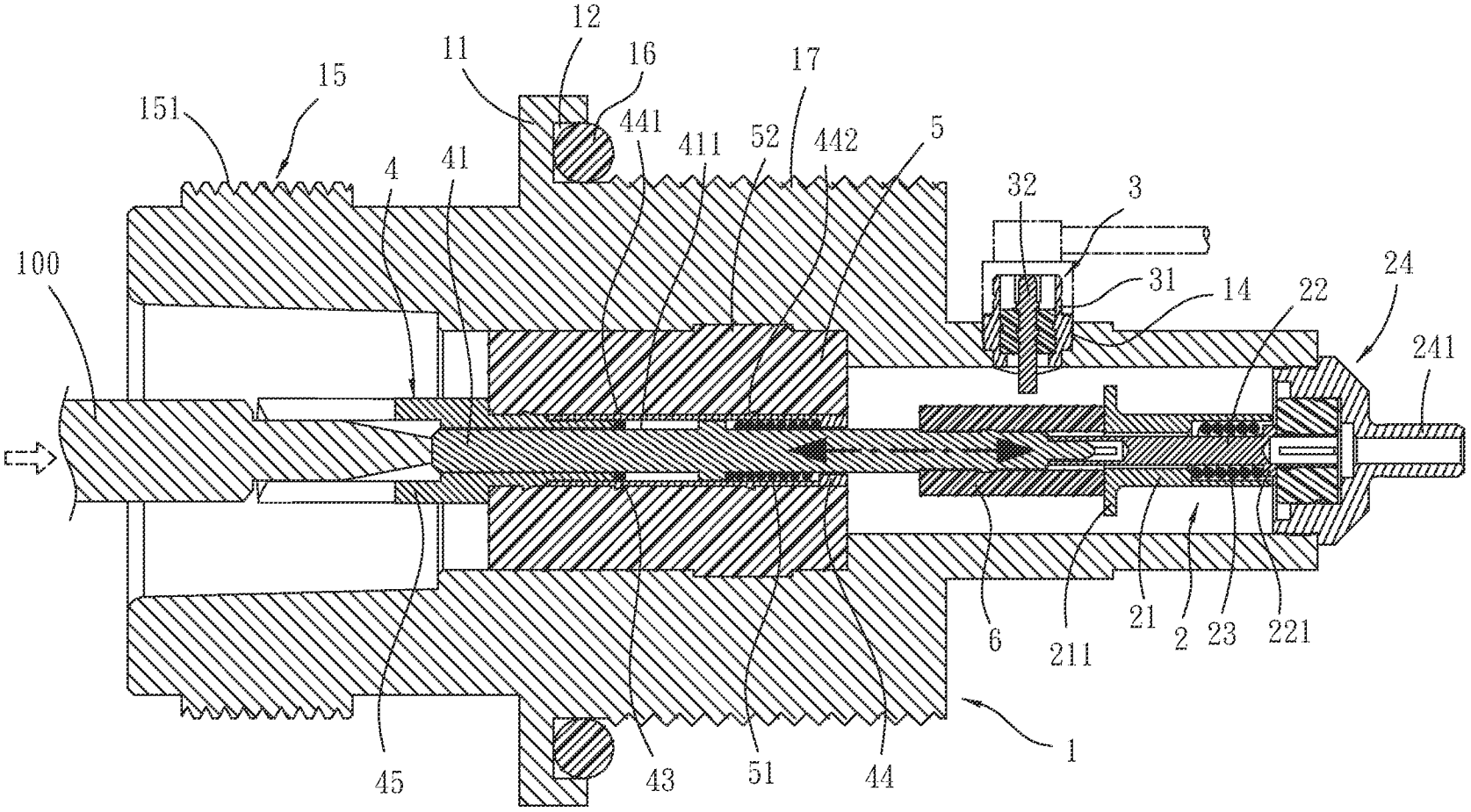
FIG. 6 is another cross sectional view of a connector of the invention when the connector is operated.
Figure 7:
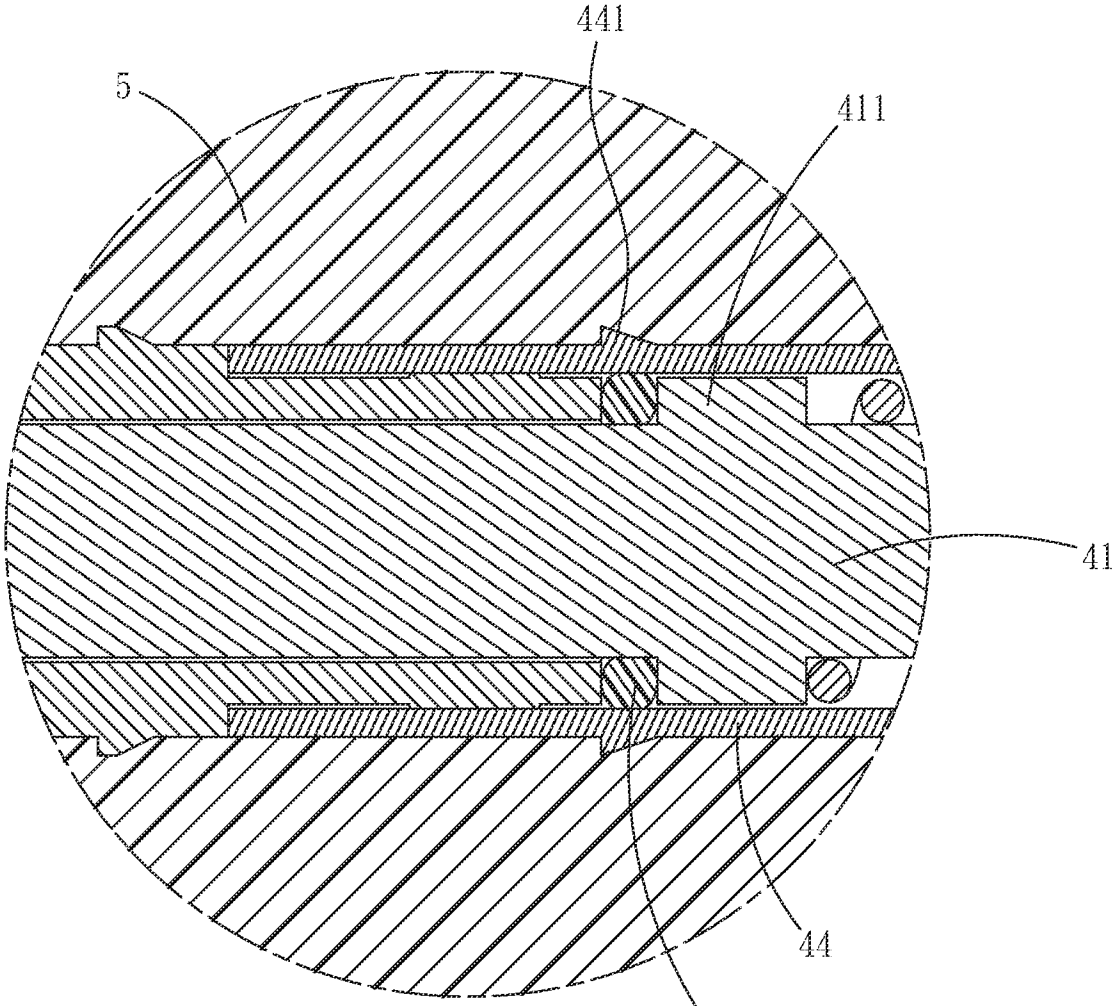
FIG. 7 is a cross sectional view of partial structure of a connector of the invention.
Figure 8:
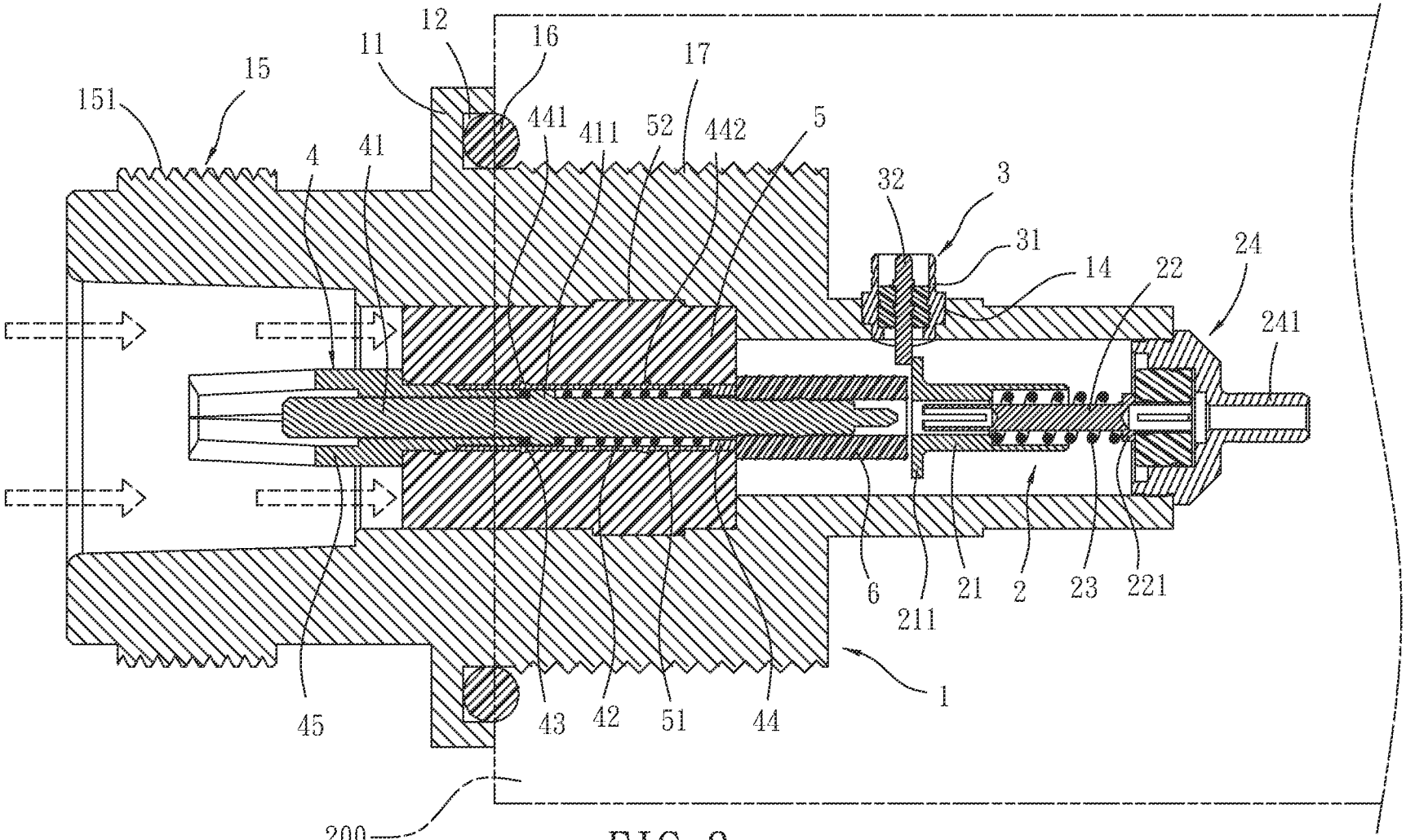
FIG. 8 is a schematic view of a waterproof operation of a connector of the invention.

Please referring to FIG. 5, which is a schematic sectional view of the operation of the assembled structure of this invention. As shown in FIG. 5, when the connector is not connected, the first guide element 3 is connected to the conductive module 2, so that the conductive rod 32 of the first guide element 3 disconnects the conductive module 2 and the conductive module 4; as shown in FIG. 6, another schematic cross-sectional view of the operation of the assembled structure, an external connector 100 connected to the connector correspondingly connects the central pin 41 of the conductive module 4 and pushes the conductive module 4 to move in the direction of the connecting module 2. The protective sleeve 6 is pushed away from the guide rod 32 of the first guide element 3, and finally the central pin 41 moves through the guide element 22 to form electrically connection, and the protective sleeve 6 insulates the first guide element 3, so that the electrical signals of the conductive module 4 and the connecting module 2 are maintained stable. In addition, as shown in FIG. 7, a second waterproof gasket 43 set on the center pin 41 enhances the waterproof effect of the conductive module 4. The sleeve 44 has a first chamfer 441 and a second chamfer 442 on the outer peripheral surface thereof. The first waterproof gasket 16 disposed outsides provides waterproof protection function. As shown in FIG. 8, the connector is fixedly connected to a waterproof tester 200 through the screw 17 and pushed to the first waterproof gasket 16. After the test of the waterproof tester 200, the generated water cannot flow into the connecting module 2 through the internal structural gap of the connector, thus no short circuit problem occurs, which leads to a tighter waterproof effect inside the main base body 1.

Figure 9:
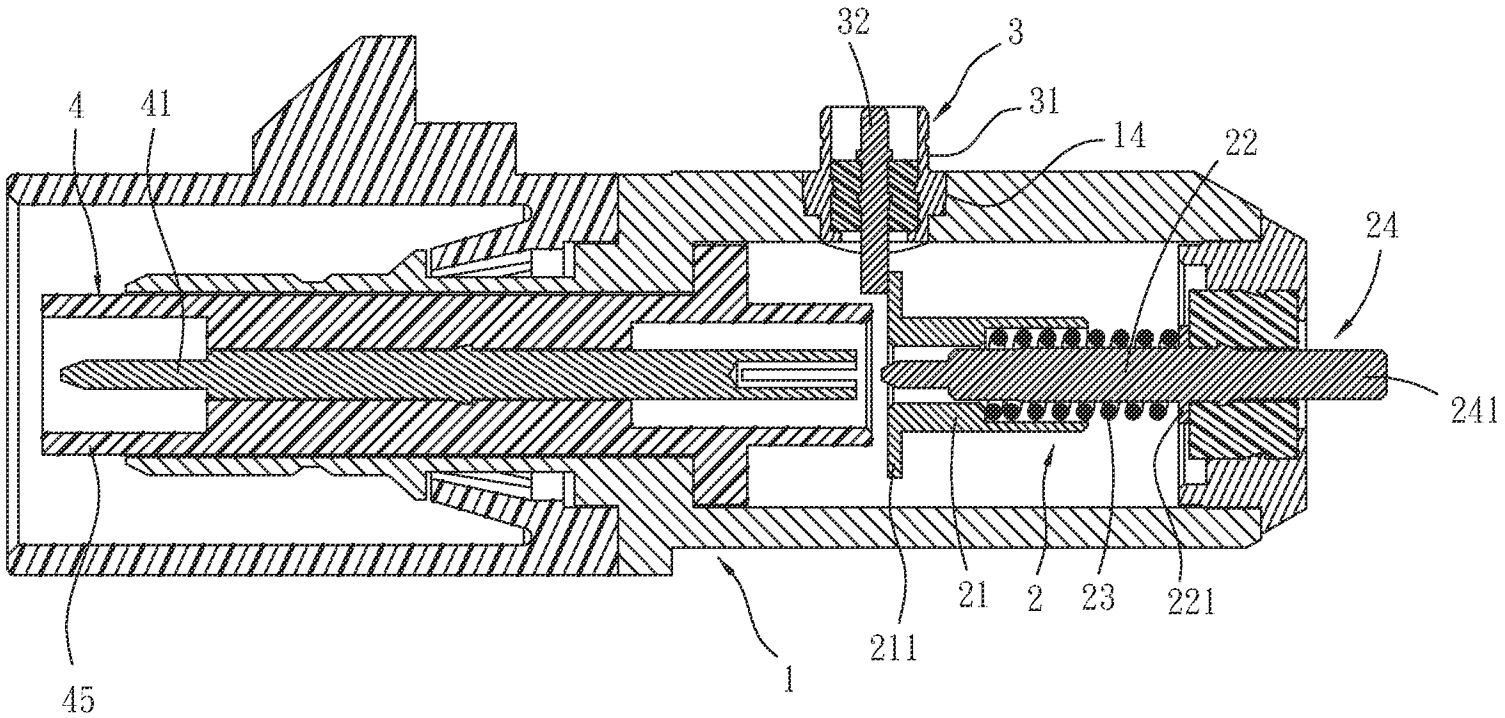
FIG. 9 is a cross sectional view of a second embodiment of a connector of the invention.
Figure 10:
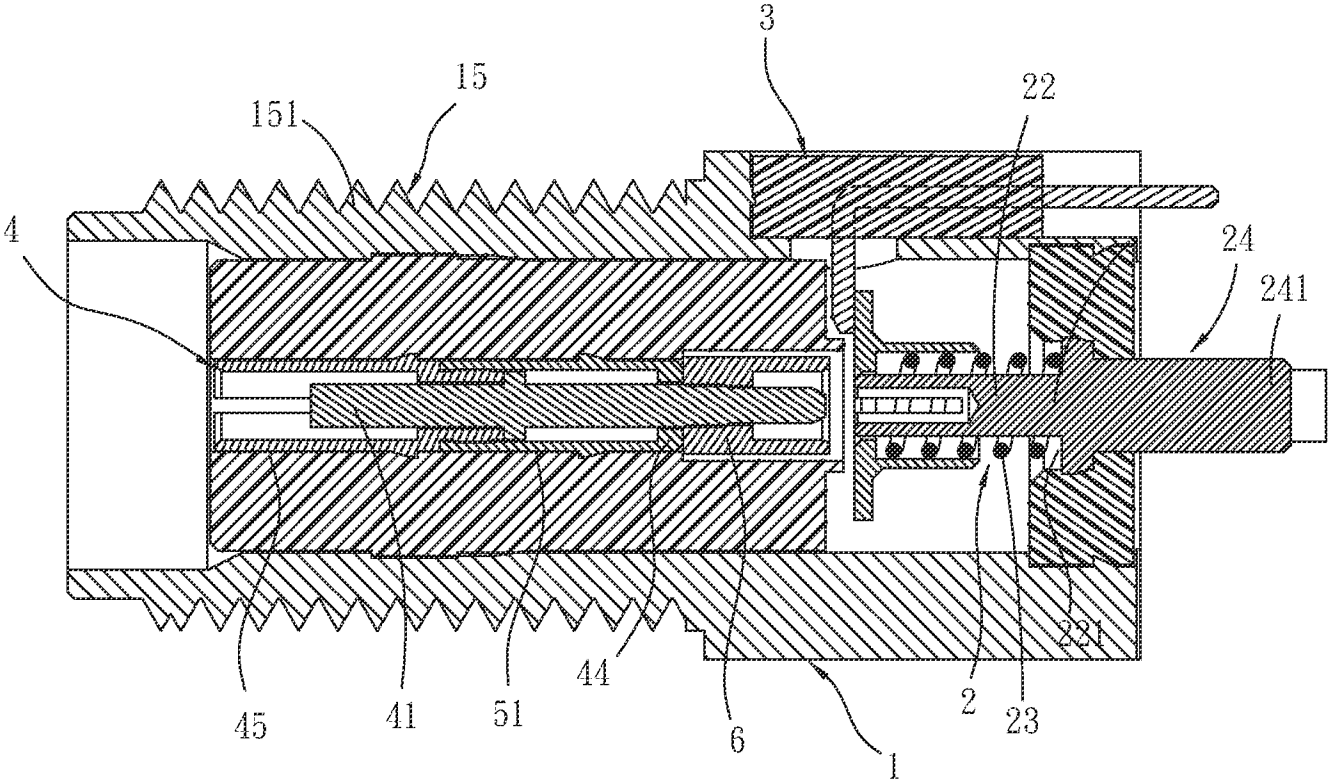
FIG. 10 is a cross sectional view of a third embodiment of a connector of the invention.

In addition, please referring to FIGS. 9 and 10, which are cross sectional view of a second embodiment and a third embodiment of the invention, respectively. FIGS. 9 and 10 show the waterproof structure of the invention. The waterproof structure of this invention can be adapted for different types of connectors, including the connector structure of the male type and other types of connector designs as shown in FIG. 10. The protective sleeve 6 shown in the cross sectional view of the third embodiment for increasing the stability of the circuit (signal) is made of a metal material in this embodiment.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A connector, comprising:

a main base body, wherein one end of the main base body is provided with a guide sleeve, the outer peripheral surface of the guide sleeve has a through hole, the through hole is communicated with the main base body, and the other end of the main base body has a butting hole;

a connecting module connected to the guide sleeve of the main base body, wherein the connecting module further comprises:

a connecting base being a hollow base body, wherein one end of the connecting base is connected to a circular ring plate;

a connecting element housed in the connecting base, a first end and a second end of the connecting element are in a concave shape, and a convex ring is provided on the outer peripheral surface of the connecting element;

a first elastic element sleeved on the outer peripheral surface of the connecting element and is accommodated in the connecting base along with the first end of the connecting element, one end of the first elastic element props against the convex ring;

a butting seat connected to the second end of the connecting element and correspondingly connecting the guide sleeve, so that the connecting module is fixed on the main base body, and a butting sleeve extends outwardly from the butting seat; and a first guide element corresponds with and being inserted into the through hole of the main base body, the first guide element has a receiving seat having a size corresponding to a size of the through hole, a guiding rod is provided in the receiving seat, and the guiding rod is movable in the receiving seat and extends into the main base body; and a conductive module housed in the main base body, wherein the conductive module further comprises:

a central pin, a convex seat is provided on the outer peripheral surface of the central pin, and one end of the central pin has a conductive tip;

a second elastic element sleeved on a pin body of the central pin with one end thereof propping on the convex seat;

a second waterproof gasket sleeved on the central pin and abutting against the other side of the convex seat;

a sleeve housing the central pin and having a first chamfer and a second chamfer on an outer peripheral surface thereof, and the sleeve simultaneously accommodates the conductive tip and the second elastic element;

a conductive base is correspondingly connected to the sleeve, the central pin is sleeved in the sleeve and the conductive base, the other end of the central pin is located in the conductive base, and the conductive tip is exposed outside the sleeve;

a fixing seat accommodated in the main seat body, wherein a through slot is provided at the axial position of the fixed seat, the through slot is configured to receive the sleeve, the conductive tip of the center pin is exposed from the fixing seat, a waterproof layer is projected outwardly on the outer peripheral surface of the fixing seat, and the waterproof layer is closely fitted to the inner peripheral surface of the main base body; and an protective sleeve sleeving the conductive tip for insulation.

2. The connector as claimed in claim 1, wherein the main base body is a hollow cylinder.

3. The connector as claimed in claim 1, wherein the guide sleeve is cylindrical.

4. The connector as claimed in claim 1, wherein the butting hole has a diameter larger than that of the guide sleeve.

5. The connector as claimed in claim 1, wherein the connecting base is T-shaped.

6. The connector as claimed in claim 1, wherein the butting seat is circular.

7. The connector as claimed in claim 1, wherein the first chamfer is opposite to the second chamfer.

8. The connector as claimed in claim 1, wherein the fixing seat is a hollow cylinder.

9. The connector as claimed in claim 1, wherein an annular flange is formed on the outer peripheral surface of the main base body, and the annular flange is recessed inward to form a groove.

10. The connector as claimed in claim 9, wherein the conductive module further comprises a first waterproof gasket disposed in the groove.

* * * * *